US007291035B2

(12) United States Patent
Rose et al.

(10) Patent No.: US 7,291,035 B2
(45) Date of Patent: Nov. 6, 2007

(54) SYSTEM AND APPARATUS FOR CABLE CONNECTOR FASTENING

(75) Inventors: Timothy Patrick Rose, Waukesha, WI (US); Russell Wayne Hum, Waukesha, WI (US); William T. Brennan, Delafield, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/364,764

(22) Filed: Feb. 28, 2006

(65) Prior Publication Data

US 2007/0202733 A1 Aug. 30, 2007

(51) Int. Cl.
*H01R 13/627* (2006.01)

(52) U.S. Cl. ..... 439/362

(58) Field of Classification Search ..... 439/362, 439/364; 411/7, 353

See application file for complete search history.

(56) References Cited

U.S. PATENT DOCUMENTS 4,935,847 A * 6/1990 Welsh ..... 361/801
5,197,900 A * 3/1993 Ellis et al. ..... 439/352
6,099,344 A * 8/2000 Chadbourne ..... 439/416
6,176,138 B1 * 1/2001 Barr et al. ..... 73/756
6,364,688 B1 * 4/2002 Fraley et al. ..... 439/362
6,520,791 B2 * 2/2003 Burger ..... 439/362
6,875,045 B1 * 4/2005 Hollick ..... 439/411
6,888,361 B1 * 5/2005 Engquist ..... 324/755

* cited by examiner

*Primary Examiner*—Tulsidas C. Patel
*Assistant Examiner*—Phuongchi Nguyen
(74) *Attorney, Agent, or Firm*—Cantor Colburn LLP

(57) ABSTRACT

A cable fastener is disclosed. The cable fastener includes a first portion and a second portion. A set of threads is disposed at a first end of the first portion, and a knurl is disposed at a second end of the first portion. The second portion includes an interface region disposed within a first end and a tool interface disposed upon a second end. The interface region is disposed in intimate connection upon the knurl, and the first and second portion are configured to transmit at least 12 in-lbs across the interface region and knurl without relative motion.

20 Claims, 4 Drawing Sheets

SYSTEM AND APPARATUS FOR CABLE CONNECTOR FASTENING

BACKGROUND OF THE INVENTION

The present disclosure relates generally to cable connectors, and particularly to cable connector fasteners.

In medical imaging systems, components are mounted to a gantry frame that may rotate around a patient at anywhere from 120 to 150 RPM. This rate of motion may create a hostile environment for mounting hardware by exerting acceleration loads up to 25 G's on components mounted to the rotating frame. Typically, printed circuit boards and backplanes that require power and data cable connections are mounted on the rotating gantry. Any fasteners holding components to the gantry need to be tightened properly to provide a lasting, positive connection. The cable connections are typically made by over-molded cables that use jackscrews to attach the over-mold section of the cable to the printed circuit board.

Jackscrews, which fasten the cable connectors to the circuit boards, are limited in size by available space. If excessive tightening torque is applied to jackscrews in either manufacturing or service, their threads may strip into the connector socket, or they may break within the circuit board. This type of thread damage may result in cable disconnection during gantry rotation, or require replacement of the circuit boards. In-field circuit board replacement may require extensive system down-time and cost. The jackscrew connection to the printed circuit boards needs to be assured to maintain cable connection within the rotating gantry, while application of excessive torque to jackscrews needs to be eliminated to minimize end user downtime. Accordingly, there is a need in the art for a cable connector fastening arrangement that overcomes these drawbacks.

BRIEF DESCRIPTION OF THE INVENTION

An embodiment of the invention includes a cable fastener. The cable fastener includes a first portion and a second portion. A set of threads is disposed at a first end of the first portion, and a knurl is disposed at a second end of the first portion. The second portion includes an interface region disposed within a first end and a tool interface disposed upon a second end. The interface region is disposed in intimate connection upon the knurl, and the first and second portion are configured to transmit at least 12 in-lbs (inch-pounds) of torque across the interface region and knurl without relative motion.

Another embodiment of the invention includes a cable connector for fastening a cable to a circuit board cable socket. The connector includes a plurality of cable fasteners disposed within the cable connector. Each fastener includes a first portion and a second portion. A set of threads is disposed at a first end of the first portion, and a knurl is disposed at a second end of the first portion. The second portion includes an interface region disposed within a first end and a tool interface disposed upon a second end. The interface region is disposed in intimate connection upon the knurl, and the first and second portion are configured to transmit at least 12 in-lbs of torque across the interface region and knurl without relative motion.

Another embodiment of the invention includes a gantry for a CT imaging system including a housing, a circuit board, a radiation source, and a radiation detector disposed within the housing. A set of cables provides signal and power communication between the radiation source, the radiation detector, and the circuit board, via a set of sockets disposed upon the circuit board. A cable connector is disposed on an end of each cable of the set of cables. The connector includes a plurality of cable fasteners disposed within the cable connector. Each fastener includes a first portion and a second portion. A set of threads is disposed at a first end of the first portion, and a knurl is disposed at a second end of the first portion. The second portion includes an interface region disposed within a first end and a tool interface disposed upon a second end. The interface region is disposed in intimate connection upon the knurl, and the first and second portion are configured to transmit at least 12 in-lbs of torque across the interface region and knurl without relative motion.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention includes a cable connector that utilizes a torque-limiting jackscrew configured to transmit a torque level to provide enough holding force to securely fasten the cable connectors, while limiting torque to prevent thread damage, such as stripping or fracture, of the jackscrew threads. In an embodiment, the torque-limiting jackscrew has a plastic head, with an interface configured to receive a tightening tool, molded onto the shaft of the torque-limiting jackscrew. The plastic head limits the transfer to the shaft of an applied torque at the head by deforming at a defined torque limit.

Figure 1:
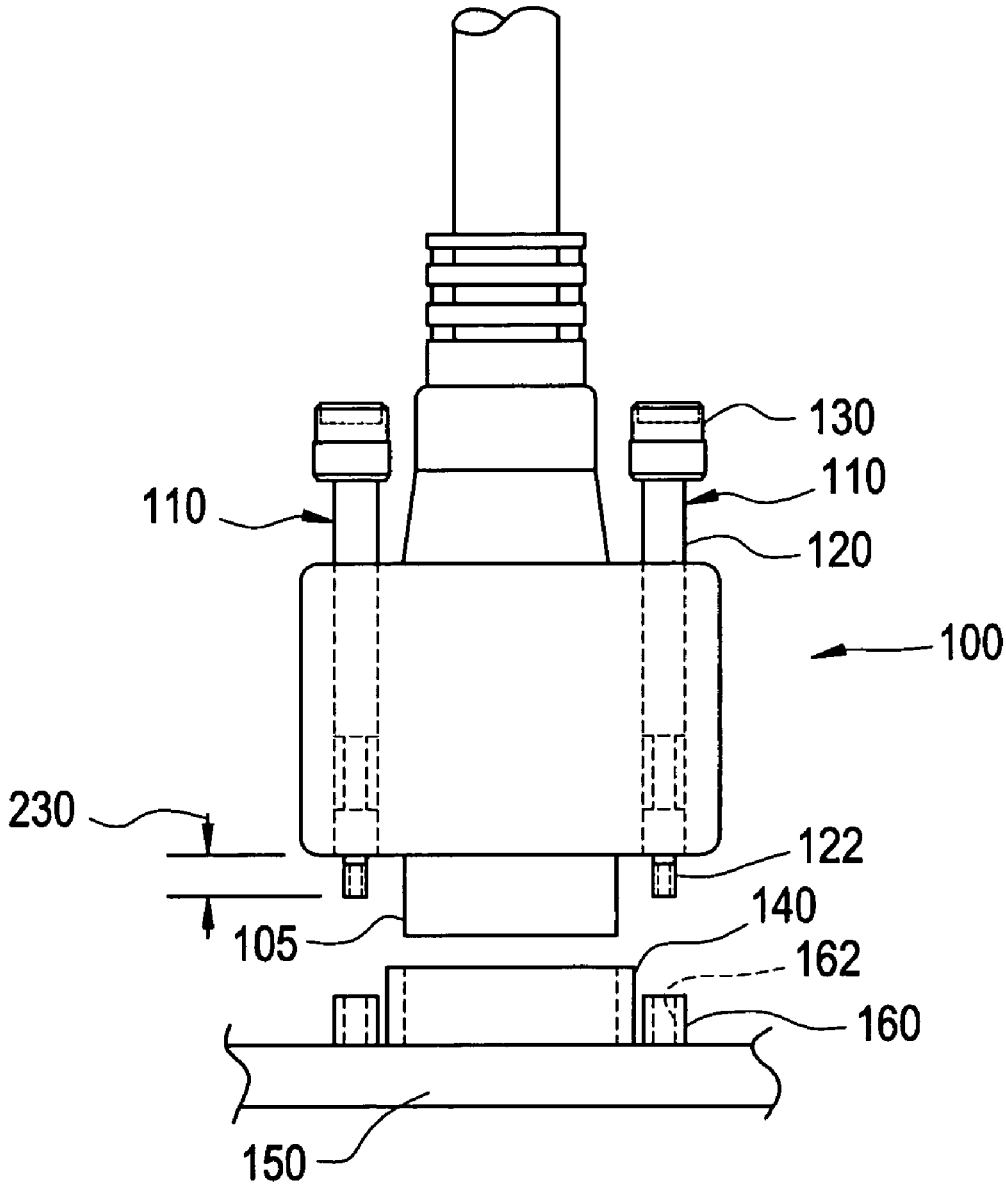
FIG. 1 depicts an exemplary cable connection system in accordance with an embodiment of the invention.

Referring now to FIG. 1, an exemplary embodiment of a cable connector 100, comprising a cable plug 105, is depicted. Two torque-limiting jackscrews (also herein referred to as cable fasteners) 110 are disposed within the cable connector 100. Each of the torque-limiting jackscrews 110 further comprises a first portion (also herein referred to as a shaft) 120, and a second portion (also herein referred to as a head) 130. Disposed upon a first end 122 of the shaft 120 is a set of external threads (also herein referred to by reference numeral 122). As used herein the reference numeral 122 may refer to either the first end of the shaft 120, or the threads disposed thereupon. The cable plug 105 is configured to interface with a socket 140 disposed upon a circuit board 150. Disposed proximate to the socket 140, two jack-sockets 160 are each configured with an internal thread 162, which matches the size of the external thread 122. Subsequent to the insertion of the cable plug 105 within the socket 140, the jackscrews 110 are tightened to secure the cable connector 100 to the circuit board 150. A thread protrusion, depicted by dimension 230 is configured to prevent the bottoming out of the threads 122 within the jack-sockets 160, thereby reducing the potential for thread 122 damage. In an embodiment, this thread protrusion may be specified to be 2.75 mm (millimeters)+/−0.25 mm.

While an embodiment of the invention has been described employing an exemplary cable connector utilizing two jackscrews with a specified thread protrusion, it will be appreciated that the scope of the invention is not so limited, and that the invention also applies to the cable connectors utilizing alternate numbers of jackscrews, such as one, three, four, or more, with any thread protrusion configured to prevent the bottoming out of the threads within the sockets, for example.

Figure 2:
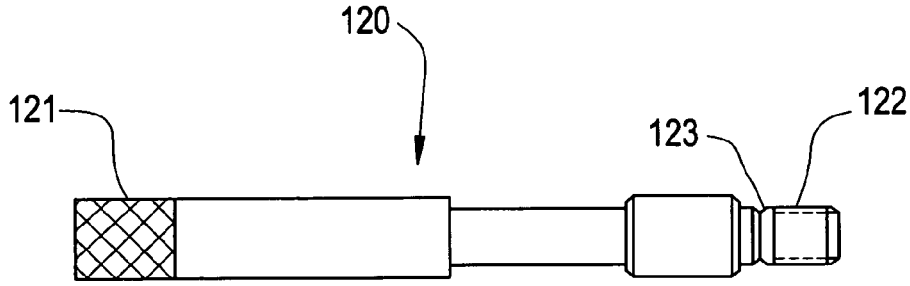
FIG. 2 depicts an exemplary jackscrew shaft in accordance with an embodiment of the invention.

Referring now to FIG. 2, an exemplary embodiment of the shaft 120 is depicted. Disposed upon a second end 121 of the shaft 120 is a knurl (also herein referred to by reference numeral 121). As used herein the reference numeral 121 may refer to either the second end of the shaft, or the knurl disposed thereupon. In an embodiment, the thread 122 may be such that it conforms to the ANSI 4-40 UNC-2A specification. Further, the knurl 121 may be such that it is defined per ANSI B94.6 1984, with a diametral pitch of 64, and a Class I tolerance. It may be appreciated that as a result of the configuration of the shaft 120 to accommodate available space restrictions in an application, a common mode of thread 122 damage may be fracture of the threads 122. If the threads 122 fracture, or the internal threads 162 (depicted in FIG. 1) are stripped, replacement of the circuit board 150 will likely be required, which is an expensive and time-consuming repair.

In an embodiment, the shaft 120 is configured to withstand a range of torque that measures between 6 in-lbs (inch-pounds) to 24 in-lbs, or more specifically, 10 in-lbs to 24 in-lbs, or even more specifically, 22 in-lbs to 24 in-lbs prior to stripping or fracture of the thread 122, and may be made from stainless steel that conforms to the ASTM specification A581 or A582. As used herein, the term between describes the measurement of applied torque at which the shaft 120 strips or breaks, and may account for material, manufacturing, and measurement tolerances. Testing of various configurations of shaft 120 has determined that presence of an undercut 123 may lead to jackscrew 110 fracture. For this reason, an embodiment of the invention may utilize a thread 122 that does not include an undercut 123.

While an embodiment of the invention has been described employing an exemplary jackscrew disclosed herein having an ANSI 4-40 UNC-2A thread and an ANSI B94.6 1984 knurl with a diametral pitch of 64 and a Class I tolerance, it will be appreciated that the scope of the invention is not so limited, and that the invention also applies to a jackscrew utilizing other thread sizes, such as ANSI 4-48 UNF-2A, ANSI 6-32 UNC-2A, or any other thread size which fits within the application requirements, for example, as well as any other appropriate knurl design or feature configured to unitize the head with the shaft. Further, while an embodiment of the invention has been described employing an exemplary jackscrew shaft made from ASTM A581 or A582 stainless steel, it will be appreciated that the scope of the invention is not so limited, and that the invention also applies to jackscrew shafts made from other materials, such as alternate grades of stainless steel, cold rolled steel, or other metallic or non-metallic materials, for example.

Figure 3:
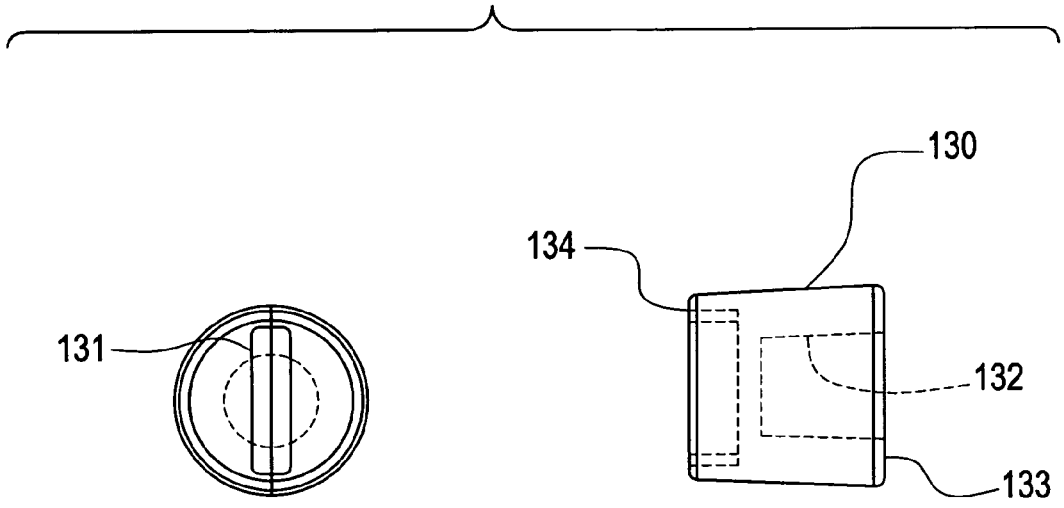
FIG. 3 depicts an exemplary jackscrew head in accordance with an embodiment of the invention.

Referring now to FIG. 3, an embodiment of the head 130 is depicted. An interface region (also herein referred to as a bore) 132 is disposed within a first end (also herein referred to as a bottom) 133 of the head 130. Disposed within a second end (also herein referred to as a top) 134 of the head 130 is a tool interface (also herein referred to as a slot) 131. With reference to FIG. 2 along with FIG. 3, the bore 132 is disposed upon and in intimate connection with the knurl 121. The geometry of the bore 132 is configured such that when it is assembled to the shaft 120, the head 130 is capable of transmitting at least 12 in-lbs of torque to the shaft 120 without relative motion between the head 130 and the shaft 120.

While embodiments of the invention are depicted with head 130 having a bore 132 configured to be disposed upon and in intimate connection with the knurl 121, it will be appreciated that the scope of the invention is not limited to a preformed bore 132 in head 130, but also includes a head 130 having a bore 132 that would result if the head 130 were molded onto the shaft 120 such that the bore 132 is disposed upon and in intimate connection with the knurl 121.

In an exemplary embodiment of the invention, the slot 131, in combination with selection of the appropriate material for the head 130, is configured to limit the torque transferred between the head 130 and the shaft 120. In an embodiment and in response to the application of torque to the head 130 via a tool (not depicted) inserted within the slot 131, the slot 131 will deform at a defined range of torque, between 2 in-lbs and 10 in-lbs. In another embodiment, the slot 131 will deform at a torque range between 6 in-lbs and 10 in-lbs. In yet another embodiment, the slot 131 will deform at a torque range between 8 in-lbs and 10 in-lbs. In an exemplary embodiment, the head may be made from thermoplastic polymer within the nylon-6 series.

While an embodiment of the invention has been described employing an exemplary head with a slot, it will be appreciated that the scope of the invention is not so limited, and that the invention also applies to a head having alternate tool interface geometry, such as hex, PHILLIPS, or TORX geometry for example. It will also be appreciated that the scope of the invention may have tool interface geometry on the head exterior, and that fingers may be considered to be the tool for torque application. Further, while an exemplary embodiment of the invention has been described employing a head made from thermoplastic polymer within the nylon-6 series, it will be appreciated that the scope of the invention is not so limited, and that the invention also applies to a head comprising alternate materials, such as thermoset polymers, ferrous and nonferrous metallic alloys, and composite materials, for example.

Figure 4:
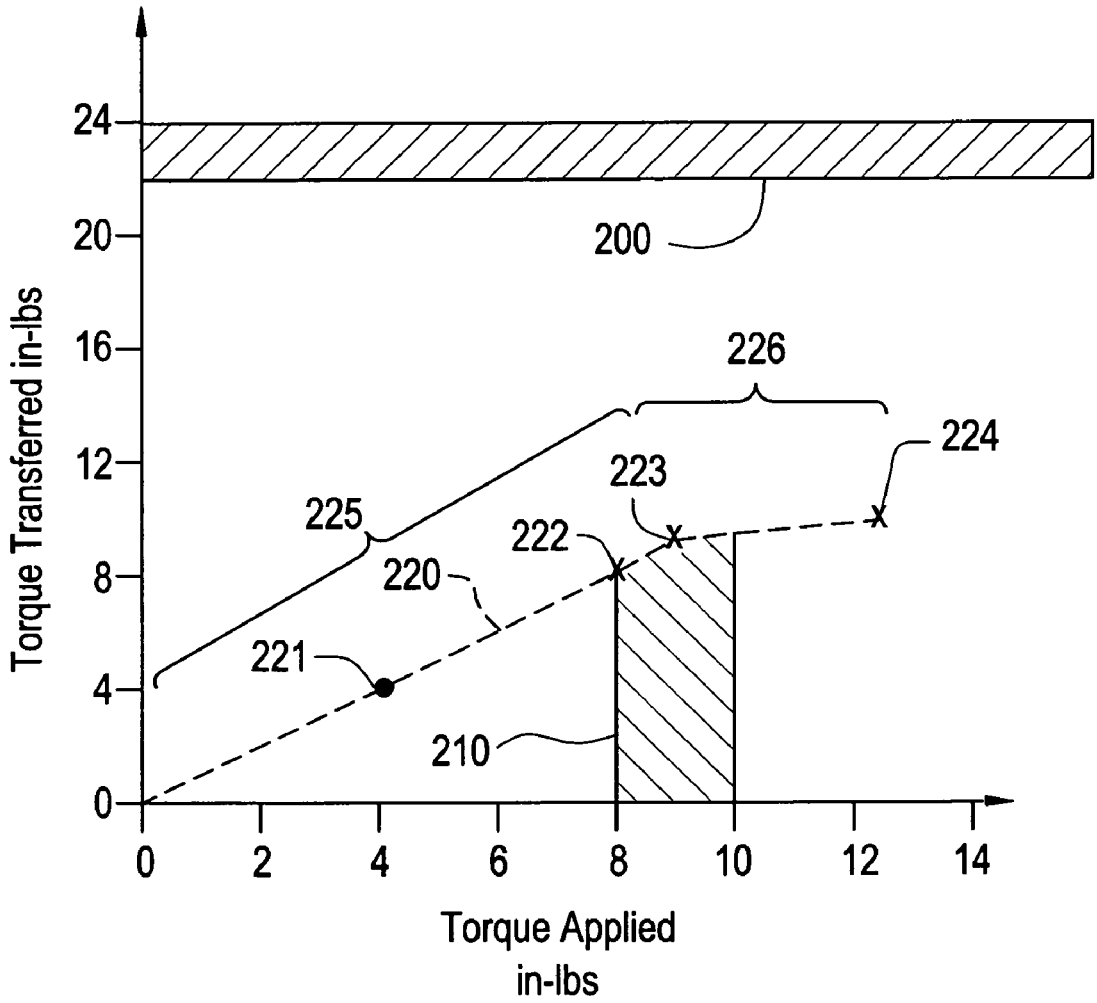
FIG. 4 depicts a graph illustrating a characteristic torque curve in accordance with an embodiment of the invention.

Referring now to FIG. 4, a graph illustrating a characteristic torque curve 220 is depicted. Additionally, bars 210, 200 representing torque limit ranges, and a point 221, representing a target tightening torque, are depicted. The x-Axis represents the torque applied to the slot 131, while the y-Axis represents the torque transferred by the head 130 to the shaft 120 of the jackscrew 110. The relationship between applied and transferred torque is defined by the characteristic curve 220. The vertical bar 210 depicts the zone of torques in which deformation of the slot 131 is likely to occur. Experimental testing has determined that in accordance with an embodiment of the invention, the slot 131 will deform at an applied torque within the range between 8 in-lbs and 10 in-lbs. Similar experimental testing has determined that, in accordance with an embodiment of the invention, the shaft 120 is likely to be damaged at an applied torque value within the range between 22 and 24 in-lbs. This damage zone is represented by the horizontal bar 200. A point 221 represents a target tightening torque of 4 in-lbs, which has been found to provide satisfactory retention of the cable connector 100 to the circuit board 150. Ideally, service and assembly technicians are instructed to utilize torque-measuring devices to attain this target. However, there may exist conditions wherein a technician may inadvertently apply an excessive level of torque to the tool interface 131.

The quantity of torque applied to the tool interface 131 that is transmitted to the shaft 120 is described via the characteristic curve 220. The characteristic curve 220 has 2 zones. Within a first zone 225 of the characteristic curve 220, any amount of torque applied to the tool interface 131 beneath the torque level at which the slot 131 may begin to deform (depicted in FIG. 4 as point 222) is transferred to the shaft 120 in a direct, linear relationship. As described above, experimental testing has determined that the slot 131 will deform at some torque level between 8 in-lbs and 10 in-lbs. In the embodiment represented by the characteristic curve 220, a second zone 226 of the characteristic curve 220 begins in response to the start of deformation, represented by a point 223, and is illustrated by a change in slope of the characteristic curve 220. As additional torque is applied to the tool interface 131 subsequent to the start of deformation represented by the point 223, the amount of torque transferred is no longer a linear function, and will cease at some critical torque value represented by point 224. It is expected that the critical torque will be no more than about the upper deformation torque level. In the embodiment described herein, this is about 10 in-lbs. As used here, the term "about" represents a minimum amount of variation, resulting from differences within material, geometry, and measurement tolerances. Accordingly, and in accordance with an embodiment of the invention, the torque transferred to the shaft 120 by the head 130 is limited to a value that prevents damage to shaft 120.

Stated alternatively, it may be appreciated that because the slot 131 will deform at an applied torque of between 8 in-lbs and 10 in-lbs, an excessive application of torque beyond the target value of 4 in-lbs will provide adequate retention of the cable connector 100. However, in response to the excessive torque application, deformation of the slot 131 reduces transmission of additional torque beyond the start of deformation point 223 to the shaft 120, thereby maintaining a torque level well below the measured damage threshold of between 22 in-lbs and 24 in-lbs for the shaft 120.

While an embodiment of the invention has been described depicting a specific start of deformation point within a range of torques, it will be appreciated that the scope of the invention is not so limited, and that the invention also applies to any start of deformation point within the range of torques.

Referring back to FIG. 1, it may be appreciated that subsequent to an application of excessive torque, the torque-limiting jackscrew 110 may be withdrawn and removed from the cable connector 100, and replaced with a new torque-limiting jackscrew 110. This jackscrew 110 replacement is significantly less expensive and time consuming than the circuit board replacement that it prevents. Furthermore, the torque-limiting jackscrew 110 is configured to be able to replace a non torque-limiting jackscrew within a cable connector 100.

Figure 5:
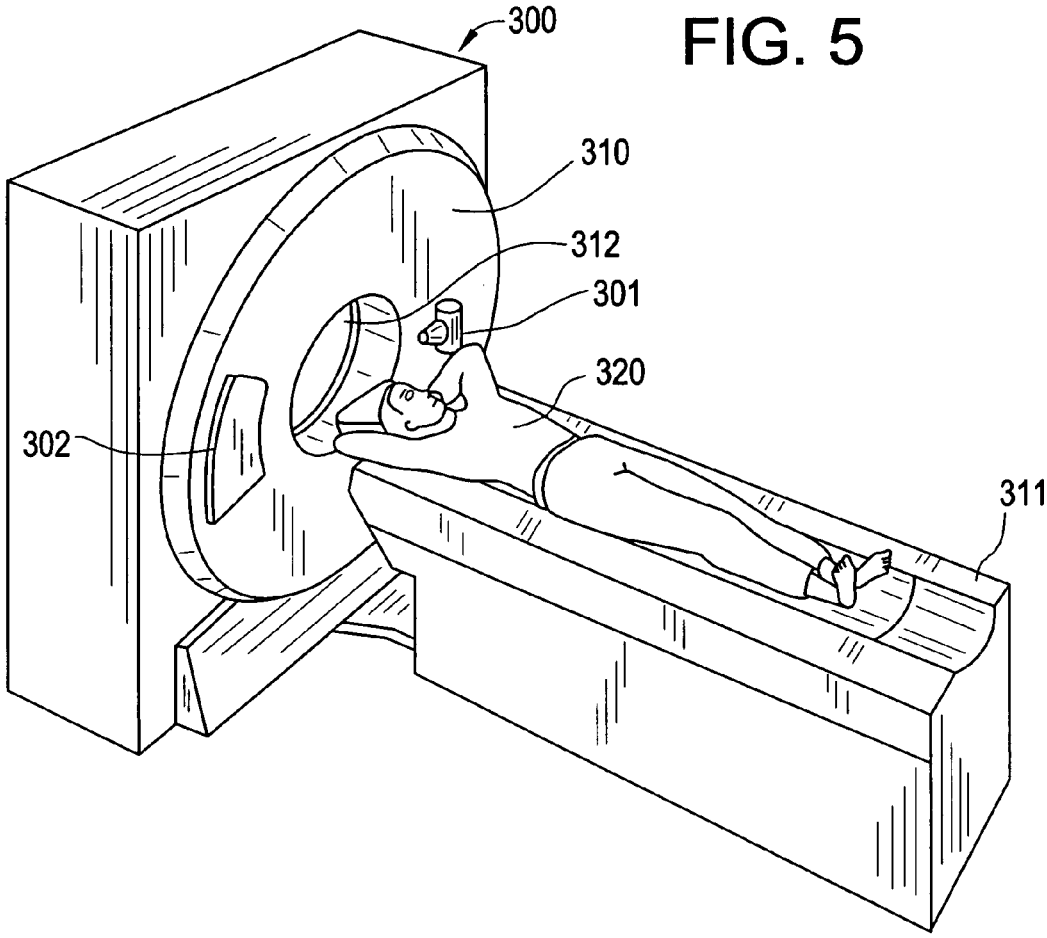
FIG. 5 depicts a top perspective view of an exemplary CT Imaging system in accordance with an embodiment of the invention.
Figure 6:
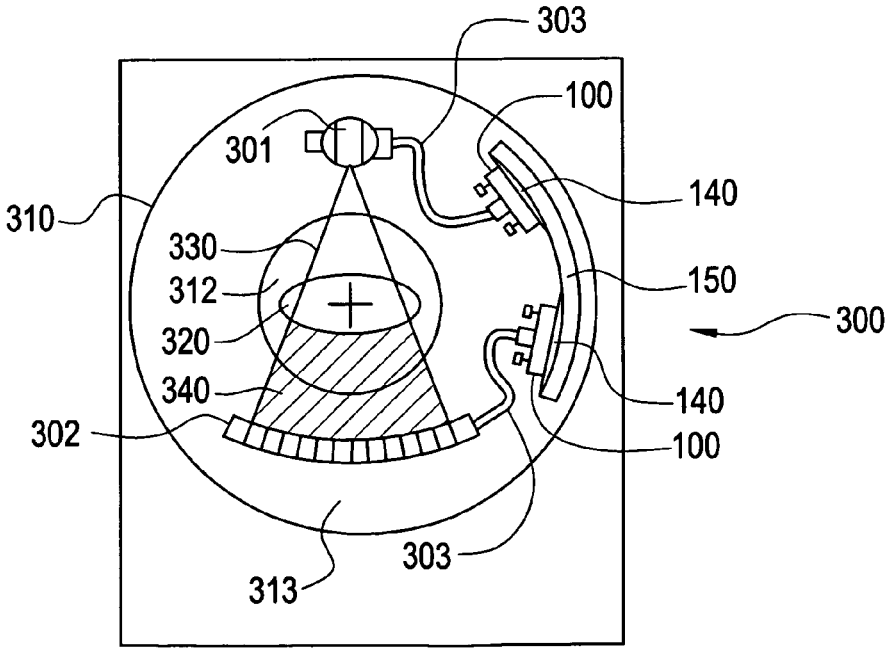
FIG. 6 depicts a schematic end view of an exemplary CT Imaging system in accordance with an embodiment of the invention.

FIGS. 5 and 6 depict an exemplary CT imaging system 300 including a gantry 310 having a housing 313, an x-ray source 301, a radiation detector array 302, a patient support structure 311 and a patient cavity 312. The x-ray source 301 and the radiation detector array 302 are mounted within the housing 313, opposingly disposed so as to be separated by the patient cavity 312. In an exemplary embodiment, a patient 320 is disposed upon the patient support structure 311, which is then disposed within the patient cavity 312. The x-ray source 301 projects an x-ray beam 330 toward the radiation detector array 302 so as to pass through the patient 320. In an exemplary embodiment, the x-ray beam 330 is collimated by a collimator (not shown) so as to lie within an X-Y plane of a Cartesian coordinate system referred to as an "imaging plane". After passing through and becoming attenuated by the patient 320, the attenuated x-ray beam 340 is received by the radiation detector array 302. The radiation detector array 302 receives an attenuated x-ray beam 340 and produces an electrical signal responsive to the intensity of the attenuated x-ray beam 340.

X-ray projection data is obtained by rotating the gantry 310 around the patient 320 during a scan. The x-ray source 301, the radiation detector array 302, and the circuit board 150 are disposed within the housing 313, so as to allow the x-ray source 301 and the radiation detector array 302 to rotate with the gantry 310 around the patient support structure 311 when the patient support structure 311 is disposed within the patient cavity 312. The x-ray source 301 and the radiation detector array 302 are in power and signal communication with the circuit board 150 via a set of cables 303 that are fastened to a set of sockets 140 disposed upon the circuit board 150 via the cable connectors 100.

As disclosed, some embodiments of the invention may include some of the following advantages: capability to prevent jackscrew or jack-socket thread failure without the requirement of special tools; capability to reduce circuit board repair and replacement costs; capability to provide a secure connection despite excessive torque application; a simple and inexpensive repair subsequent to an excessive torque application and the capability to quickly replace standard (non torque-limiting) jackscrews currently in use.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A cable fastener, comprising:

a first portion and a second portion;

a set of threads disposed at a first end of the first portion;

a knurl disposed at a second end of the first portion;

an interface region disposed within a first end of the second portion; and a tool interface disposed upon a second end of the second portion;

wherein the interface region is disposed in intimate connection upon the knurl;

wherein the first and second portion are configured in combination to transmit a defined torque of at least 12 in-lbs across the interface region and knurl without relative motion; and wherein the tool interface is deformable within an applied torque range having a maximum torque value less than the defined torque, thereby limiting transmission of torque to the set of threads greater than a critical torque defined as a torque value at which damage to the set of threads occurs.

2. The cable fastener of claim 1, wherein:

the first portion is configured to withstand between 10 in-lbs and 24 in-lbs of torque.

3. The cable fastener of claim 1, wherein:

the first portion comprises stainless steel; and the second portion comprises thermoplastic polymer.

4. The cable fastener of claim 1, wherein;

in response to the application of torque to the tool interface, the tool interface is configured to transmit torque to the second portion in accordance with a defined characteristic curve.

5. The cable fastener of claim 4, wherein:

the characteristic curve comprises a first zone and a second zone;

the first zone defines a linear characteristic;

the second zone defines a non-linear characteristic corresponding to deformation of the tool interface;

the tool interface is configured to transmit at least a target tightening torque to the second portion, as defined by the first zone of the characteristic curve; and the tool interface is configured to prevent transmission of torque greater than the critical torque to the second portion, as defined by the second zone of the characteristic curve.

6. The cable fastener of claim 5, wherein:

the tool interface is configured such that the first zone of the characteristic curve has a torque value equal to or greater than zero in-lbs and equal to or less than ten in-lbs.

7. A cable connector for fastening a cable to a circuit board cable socket, the connector comprising:

a plurality of cable fasteners disposed within the cable connector;

a first portion and a second portion of each cable fastener;

a set of threads disposed at a first end of the first portion;

a knurl disposed at a second end of the first portion;

an interface region disposed within a first end of the second portion; and a tool interface disposed upon a second end of the second portion;

wherein the interface region is disposed in intimate connection upon the knurl;

wherein the first and second portion are configured in combination to transmit a defined torque of at least 12 in-lbs across the interface region and knurl without relative motion; and wherein the tool interface is deformable within an applied torque range having a maximum torque value less than the defined torque, thereby limiting transmission of torque to the set of threads greater than a critical torque defined as a torque value at which damage to the set of threads occurs.

8. The cable connector of claim 7, wherein:

the set of threads is configured so as not to bottom within the circuit board cable socket.

9. The cable connector of claim 7, wherein:

the first portion is configured to withstand between 10 in-lbs and 24 in-lbs of torque.

10. The cable connector of claim 7, wherein:

the first portion comprises stainless steel; and the second portion comprises thermoplastic polymer.

11. The cable connector of claim 7, wherein:

in response to the application of torque to the tool interface, the tool interface is configured to transmit torque to the second portion in accordance with a defined characteristic curve.

12. The cable connector of claim 11, wherein:

the characteristic curve comprises a first zone and a second zone;

the first zone defines a linear characteristic;

the second zone defines a non-linear characteristic corresponding to deformation of the tool interface;

the tool interface is configured to transmit at least a target tight torque to the second portion, as defined by the first zone of the characteristic curve; and the tool interface is configured to prevent transmission of torque greater than the critical torque to the second portion, as defined by the second zone of the characteristic curve.

13. The cable connector of claim 12, wherein:

the tool interface is configured such that the first zone of the characteristic curve has a torque value equal to or greater than zero in-lbs and equal to or less than ten in-lbs.

14. A gantry for a CT imaging system comprising a housing;

a circuit board, a radiation source, and a radiation detector disposed within the housing;

a set of sockets disposed upon the circuit board;

a set of cables providing signal and power communication between the radiation source, the radiation detector, and the circuit board a cable connector disposed on an end of each cable of the set of cables;

a plurality of cable fasteners disposed within the cable connector;

a first portion and a second portion of each cable fastener;

a set of threads disposed at a first end of the first portion;

a knurl disposed at a second end of the first portion;

an interface region disposed within a first end of the second portion; and a tool interface disposed upon a second end of the second portion;

wherein the interface region is disposed in intimate connection upon the knurl;

wherein the first and second portion are configured in combination to transmit a defined torque of at least 12 in-lbs across the interface region and knurl without relative motion therebetween; and wherein the tool interface is deformable within an applied torque range having a maximum torque value less than the defined torque, thereby limiting transmission of torque to the set of threads greater than a critical torque defined as a torque value at which damage to the set of threads occurs.

15. The gantry for a CT imaging system of claim 14, wherein:

the set of threads is configured so as not to bottom within the circuit board cable socket.

16. The gantry for a CT imaging system of claim 14, wherein:

the first portion is configured to withstand between 10 in-lbs and 24 in-lbs of torque.

17. The gantry for a CT imaging system of claim 14, wherein:

the first portion comprises stainless steel; and the second portion comprises thermoplastic polymer.

18. The gantry for a CT imaging system of claim 14, wherein:

in response to the application of torque to the tool interface, the tool interface is configured to transmit torque to the second portion in accordance with a defined characteristic curve.

19. The gantry for a CT imaging system of claim 18, wherein:

the characteristic curve comprises a first zone and a second zone;

the first zone defines a linear characteristic;

the second zone defines a non-linear characteristic corresponding to deformation of the tool interface;

the tool interface is configured to transmit at least a target tightening torque to the second portion, as defined by the first zone of the characteristic curve; and the tool interface is configured to prevent transmission of torque greater than the critical torque to the second portion, as defined by the second zone of the characteristic curve.

20. The gantry for a CT imaging system of claim 19, wherein:

the tool interface is configured such that the first zone of the characteristic curve has a torque value equal to or greater than zero in-lbs and equal to or less than ten in-lbs.

* * * * *